United States Patent [19]

Appel et al.

[11] 3,955,261

[45] May 11, 1976

[54] EMBOSSED DECORATIVE FACING PANEL

[76] Inventors: Carl Appel, Renngasse 6, 1010 Vienna; Wilhelm Heiss, Rustenstrasse 2, Gmunden, Upper Austria; Helmuth Gsöllpointner, Enzmullner Weg 32, Linz, Donau, all of Austria

[22] Filed: May 23, 1974

[21] Appl. No.: 472,826

Related U.S. Application Data

[62] Division of Ser. No. 331,095, Feb. 9, 1973, Pat. No. 3,839,893.

[30] Foreign Application Priority Data

Feb. 17, 1972 Austria ..... 1319/72

[52] U.S. Cl. ..... 29/180 SS; 29/193; 29/193.5

[51] Int. Cl.[2] ..... B44C 5/04

[58] Field of Search ..... 29/180 SS, 193, 193.5

[56] References Cited

UNITED STATES PATENTS

| | | | |
|---|---|---|---|
| 2,577,423 | 12/1951 | Ludwig et al. | 29/180 SS |
| 2,684,291 | 7/1954 | Wilson et al. | 156/10 |
| 2,941,930 | 6/1960 | Mostovych et al. | 29/183 UX |
| 3,109,331 | 11/1963 | Cordray et al. | 29/183 X |
| 3,280,614 | 10/1966 | Cordray et al. | 29/180 R X |

*Primary Examiner*—L. Dewayne Rutledge
*Assistant Examiner*—Arthur J. Steiner
*Attorney, Agent, or Firm*—Cushman, Darby & Cushman

[57] ABSTRACT

Panel of nonferrous metal sheet for covering facings, particularly a panel consisting of aluminium metal sheet, characterized in that said panel has an embossed surface provided with irregular areal depressions predominantly having a width of at least 10 mm and a depth of 10 to 30%, preferably approximately 25%, of the greatest panel thickness, the total area of the depressions corresponding to 20 to 50%, preferably to approximately 25%, of the whole panel surface, and that the rear side of the panel is flat.

6 Claims, 5 Drawing Figures

EMBOSSED DECORATIVE FACING PANEL

Figure 1:
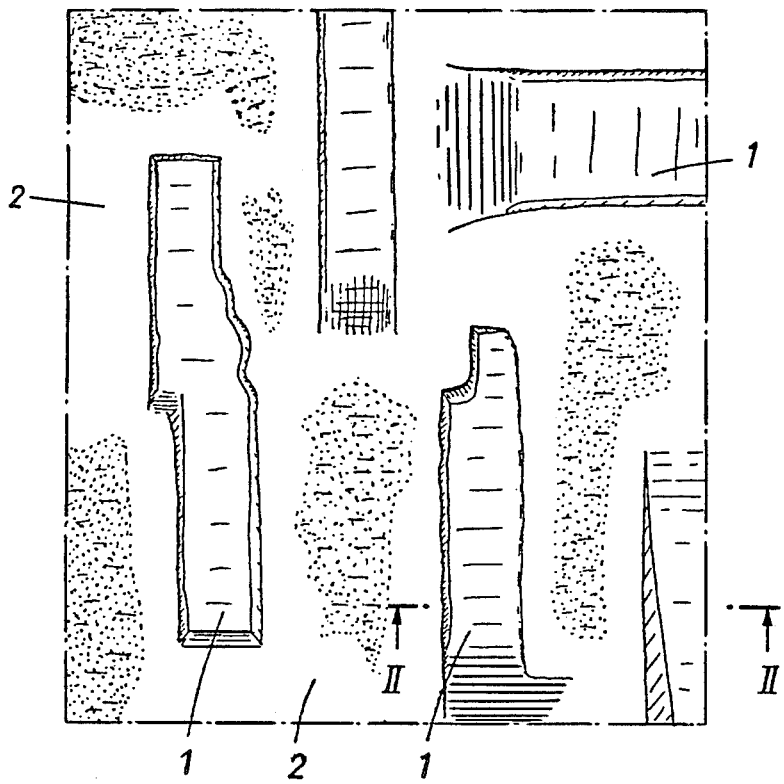

This is a division of application Ser. No. 331,095 filed Feb. 9, 1973, now U.S. Pat. No. 3,839,893.

The invention refers to a panel of nonferrous metal sheet for covering facings, particularly to a panel consisting of aluminium metal sheet, and to a process for the production of such panels.

There are already known panels of nonferrous metal for facings provided with a flat surface. Such panels are for instance produced from thin metal sheet and are provided with a backing consisting of synthetic resin. Such panels are disadvantageous inasfar as the results of weathering become quite apparent on such panels and such panels become unsightly and unattractive. When providing such panels with a regular surface profile rich in small details, f.i. with a corrugation, the desired effect is not achieved because on panels showing such a regular surface profile corrosion effects become apparent to the same extent as on a panel having a smooth surface and because such surface profiles of small dimensions are not effectively impressive at higher levels of facings of buildings. Chased panels are out of the question in view of their high price.

By the present invention the mentioned drawback can be avoided. The invention essentially consists in that the panel for facings and consisting of nonferrous metal sheet, f.i. aluminium metal sheet has an embossed surface provided with irregular areal depressions predominantly having a width of at least 10 mm and a depth of 10 to 30 %, preferably approximately 25 %, of the greatest panel thickness, the total area of the depressions corresponding to 20 to 50 %, preferably to approximately 25 %, of the whole panel surface, and that the rear side of the panel is flat. By giving the depressions a relatively vast area of relatively great width these depressions define the appearance of these panels even when arranging these panels at higher levels and, further, by giving these depressions an irregular shape and by irregularly distributing these depressions over the whole surface of the panel, these depressions, which extend over a great portion of the whole surface of the panel, are loosening up the appearance of the panel to such an extent that corrosion phenomena are no more disturbant but are rather acting in giving the effect of artificial ageing. Panels according to the invention are given a profile only at their visible side while the rear side thereof is flat, so that the profile of such panels can be produced by a rolling operation.

The process for producing panels for facings consists, according to the invention, essentially in that a metal sheet is cold rolled between a smooth roll and a roll provided with the corresponding counter-profile, the roll showing the counter-profile having the impressions and elevations distributed and dimensioned such that, based on an imaginary subdivision of the rolled sheet in longitudinal zones extending in rolling direction and each having a width corresponding to a fraction, f.i. 1/10, of the roll width, the mean reductions of cross section of the rolled sheet in all these longitudinal zones deviate from each other for maximally 15 %, preferably for not more than 8 %, and, based on an imaginary subdivision of the rolled sheet in transverse zones extending in direction of the generatrices of the roll and each having a width corresponding to a fraction, f.i. 1/20 of the roll circumference, the mean reductions of cross section of the rolled sheet in all these transverse zones deviate from each other for maximally 20 %, preferably for not more than 10 %, noting that the mean absolute reduction of cross section as calculated over the whole axial extension of the roll is from 5 to 30 % and preferably is maximally 15 %. Up till now it was not considered possible to produce when rolling metal sheets a profiled pattern comprising vast embossed surface areas of irregular shape and of irregular distribution. However, by approximating the reductions of cross section during rolling of the metal sheet within its individual longitudinal zones relative to one another and within the limits selected according to the invention and by further restricting the absolute total reduction in cross section to 30 %, preferably 15 %, the conditions resulting are such that the elongations resulting from the reductions in cross section within the individual zones do compensate one another to such an extent that distortions of the metal sheet are not to be expected or that any eventual distortions can be limited such that these distortions can be removed by straightening rolls. Different reductions in cross section occurring in the individual zones in view of the depressions having a vast surface extension do not have any effect on the whole panel because the individual zones will mutually equilibrate one another unless the effect of these different reductions in cross section are not compensated by the flow of material. Any differences of the reductions in cross section within the individual transverse zone would result in an ununiform rolling speed but these differences are, according to the invention, kept within non-disturbing limits. It has been found that it is possible to produce by continuously rolling metal sheets, panels having depressions of such large surface extension that the depressions dominate the appearance of the panel even when mounting the panel at high levels and of such a depth that a well defined demarcation relative to the elevations is obtained. According to the invention the metal sheet used has preferably a thickness of 5 to 8 mm, particularly approximately 6 mm. In this case depressions having a depth of about 30 % of the greatest thickness of the panel have a depth of approximately 2 mm resulting in a good contrast.

The lower limit of approximately 5 % for the mean absolute reduction in cross section has been selected for the purpose of precisely forming also the elevations of the panel surface by the profile of the roll. The necessary depressions are manually worked into the roll surface so that irregularities are produced which further contribute to the appearance of the panel produced. According to the invention it is preferred to manually work the whole surface of the profiled roll so that irregularities as are typical for manually working become effective not only at the area of the depressions but also at the area of the remainder of the whole roll surface. In this manner, panels for facings are provided which give quite a peculiar optical impression simulating a manual production of the panels in spite of the panels having been mechanically produced. Thus it is made possible to erect facings of individual appearance in an economic manner.

The surface of the roll showing the counter-profile is, according to the invention, preferably worked in a hard or hardened condition. Working of the roll surface can simply be effected by grinding. The roll can be given the desired profile by the hands of a sculpturer so that by means of the roll obtained each panel can be given the appearance of having been produced by a sculpturer. Thus it is made possible to mass produce on an industrial scale panels representing a work of art.

In a process according to the invention one can simply do with roll sizes as usual for rolling metal sheet and with usual roll stands.

The invention is further illustrated by the accompanying drawing illustrating an embodiment of the invention.

In the drawing,

FIG. 1 represents a partial view of the surface of a panel for facings and

Figure 2:
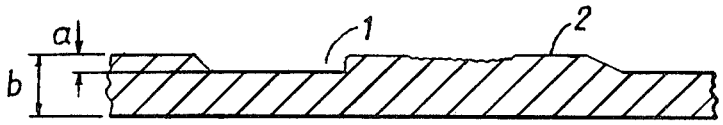

FIG. 2 in an enlarged scale a section along line II—II of FIG. 1.

Figure 3:
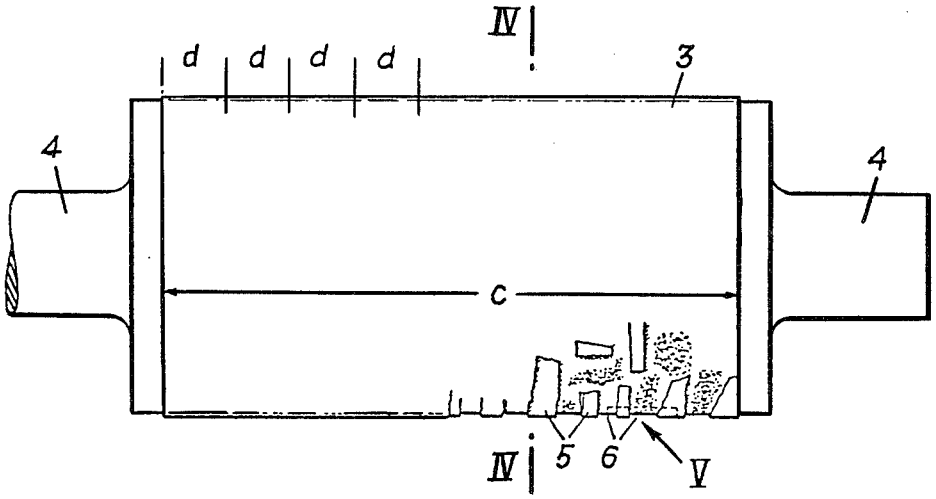
Figure 4:
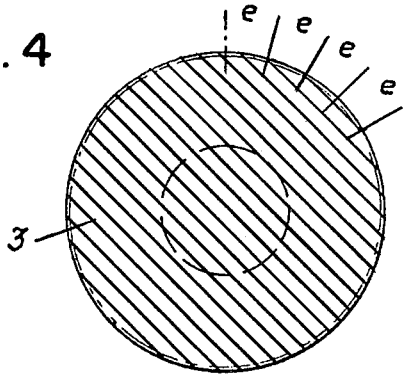

FIGS. 3 and 4 represent a profiled roll,

FIG. 3 showing a side elevation of said roll and

FIG. 4 a section along line IV—IV of FIG. 3.

Figure 5:
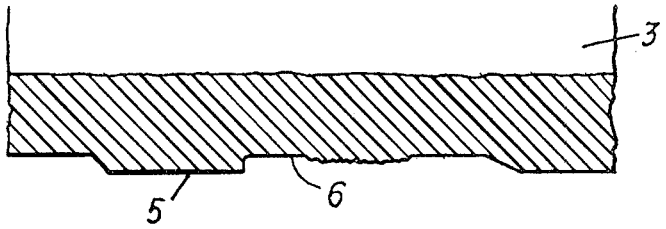

FIG. 5 represents a partial view of the surface of the roll at the area V of FIG. 3.

As is shown in FIG. 1 the panel for facings has depressions 1 of large surface extension, of varying depth and uneven bottom. The intermediate portions 2 of the roll surface are equally given an uneven surface. As is represented by FIG. 2 the depth *a* of such a depression 1 approximately corresponds to 25 % of the maximal panel thickness *b*, as can be measured at the surface areas 2. As is shown in FIG. 1, the total area of the depressions 1 is less than 50 % of the total surface area of the panel and amounts to approximately 25 % of said roll surface.

The rolls shown in FIGS. 3 and 4 correspond to a normal roll as is usually used for rolling metal sheets. Such a roll has, f.i., a diameter of 700 mm and a longitudinal working width *c* of 1200 mm. The roll shell 3 is provided with the desired profile. The roll trunnions are designated 4. The depressions 1 are manually worked into the roll shell, thus also producing the elevations 2 of the panel to be produced (FIG. 2). Depressions 1 of the panel correspond to elevations 5 of the roll shell whereas elevations 2 of the panel correspond to depressions 6 in the roll shell (FIG. 5). The roll surface is worked in a hard or hardened condition, thus providing two advantages. On the one hand, the profile produced in the roll surface is not impaired by subsequent hardening and, on the other hand, excessive worn rolls or unsuitable rolls of a sheet metal roll mill can be used, because the surface of the roll shell is to be irregular at any rate. The whole surface of the roll shell is mechanically treated, f.i. by means of grinding discs, as well as at the area of the impressions 6 as well as at the area of the elevations 5.

In FIG. 3, imaginary longitudinal zones *d* are represented, which extend in longitudinal direction of the rolling stock, i.e. the roll sheet. The width of such a longitudinal zone *d* corresponds to 1/10 of the roll width *c*. The arrangement is such that the reduction in cross section of the roll stock is approximately the same within all of these longitudinal zones and that the reduction in cross section in all of these longitudinal zones does not deviate for more than 15 %, preferably for more than 8 %, from one another. Thus stretching of the sheet material is as far as possible made equal over the whole width of the roll.

According to FIG. 4 the roll circumference is subdivided into imaginary transverse zone *e*, which extends in transverse direction to the rolling direction and therewith in direction to the generetrices of the roll and have a width corresponding to 1/20 of the roll circumference. In this connection the roll is also given a profile such that the reductions in cross section are as far as possible equal to one another in all of said transverse zones *e* and do not deviate from one another for more than 20 %, preferably maximally 10 %.

Behind the roll giving the panel the desired profile, the panel obtained is passed through the gap of smooth straightening rolls and thus straightened.

The smooth straightening roll operating at the side of the profiled roll is acting upon the panel only at the elevated areas so that at these areas a relatively high specific pressure per unit of surface area is exerted. At the areas in question, the profiled panel will be smoothed so that an additional optical effect is provided by this straightening roll. The straightening roll smoothening the panel at the most elevated areas thereof will thus produce somewhat polished areas differing from the rough areas of the panel.

What we claim is:

1. In an improved decorative panel of nonferrous metal for covering facings wherein the panel has an embossed or textured surface, the improvement comprising an embossed surface having areas of uneven raised intermediate portions together with areas of irregular depressions having varying depths and uneven bottoms, said irregular depressions having a width of at least 10 mm, a depth varying between 10 to 30 % of the thickness of said panel and wherein the area of the bottoms of said irregular depressions occupy at least 20 % of the surface of said panel.

2. An improved decorative panel as claimed in claim 1 wherein the panel is 5–8 mm thick.

3. An improved decorative panel as claimed in claim 2 wherein the depth of said irregular depressions is about 25 % of the thickness of said panel.

4. An improved decorative panel as claimed in claim 2 wherein the area of the bottoms of said irregular depressions varies between 20 and 50 % of the surface area of said panel.

5. An improved decorative panel as claimed in claim 4 wherein the area of the bottoms of said irregular depressions is about 25 % of the surface of said panel.

6. An improved decorative panel as claimed in claim 2 wherein the nonferrous metal is aluminum.

* * * * *